US005898144A

United States Patent [19]

Sakai et al.

[11] Patent Number: 5,898,144

[45] Date of Patent: Apr. 27, 1999

[54] ANTI-CHATTERING CONTACT STRUCTURE AND COLLISION DETECTING APPARATUS USING THE SAME

[75] Inventors: Makoto Sakai, Kariya; Yoshihisa Ogata, Chiryu, both of Japan

[73] Assignee: Denso Corporation, Kariya, Japan

[21] Appl. No.: 09/065,541

[22] Filed: Apr. 24, 1998

[30] Foreign Application Priority Data

Apr. 25, 1997 [JP] Japan ..... 9-123480

[51] Int. Cl.[6] ..... H01H 35/14

[52] U.S. Cl. ..... 200/61.45 R; 200/61.53

[58] Field of Search ..... 73/488, 514.01, 73/514.16, 514.17, 514.21, 514.22, 514.23, 514.24, 514.36–514.38; 200/61.45 R–61.45 M

[56] References Cited

U.S. PATENT DOCUMENTS

| | | | |
|---|---|---|---|
| 4,814,564 | 3/1989 | Ritter | 200/288 |
| 5,034,580 | 7/1991 | Tada et al. | 200/61.45 R |
| 5,059,751 | 10/1991 | Woodman et al. | 200/61.45 M |
| 5,192,838 | 3/1993 | Breed et al. | 200/61.45 R |
| 5,233,141 | 8/1993 | Breed | 200/61.45 R |
| 5,756,948 | 5/1998 | Husby et al. | 200/61.53 |

FOREIGN PATENT DOCUMENTS 8-264088 10/1996 Japan .

*Primary Examiner*—Michael A. Friedhofer
*Attorney, Agent, or Firm*—Pillsbury Madison & Sutro LLP

[57] ABSTRACT

A contact structure composed of a pushing side blade spring member with a first contact point and a receiving side blade spring member with a second contact point. The receiving side blade spring member is composed of three blade springs slidably overlapped with each other. A driving member is disposed on an opposite side of the second blade spring member with respect to the first blade spring member and biased by the first blade spring member. When a collision occurs, the driving member is displaced against a bias force to move the first blade spring member, so that the first contact point contacts the second contact point to output a detection signal. In this case, because the second blade spring member is composed of the three blade springs, the detection signal does not have chattering thereon.

19 Claims, 4 Drawing Sheets

ANTI-CHATTERING CONTACT STRUCTURE AND COLLISION DETECTING APPARATUS USING THE SAME

CROSS REFERENCE TO RELATED APPLICATION

This application is based upon and claims the benefit of priority of the prior Japanese Patent Application No. 9-123480 filed on Apr. 25, 1997, the contents of which are incorporated herein by reference.

BACKGROUND OF THE INVENTION

1. Field of the Invention

The present invention relates to an anti-chattering contact structure for a blade spring contact point, particularly for a collision detecting apparatus, which mechanically operates by inertia to start a passenger protective system such as an air bag apparatus.

2. Related Arts

A mechanical collision detecting apparatus for starting a passenger protective system such as an air bag apparatus conventionally has a structure shown in FIG. 4, which is disclosed in JP-A-8-264088. In the collision detecting apparatus 20, a weight 14 is eccentrically and rotatably supported by a shaft 15. A rotor 11 formed with a first cam 11*a* and a second cam 11*b* is fixed to the weight 14. The first and second cams 11*a*, 11*b* are respectively biased by front end portions of blade springs 12, 13 with bias forces in B direction. The blade springs 12, 13 prevent the weight 14 from rotating in an A direction by low level deceleration caused when a vehicle moves. When the vehicle collides with an object to produce high level deceleration, the weight 14 rotates together with the rotor 11 in the A direction against the bias forces of the blade springs 12, 13. Due to the rotation of the rotor 11, the blade springs 12, 13 are displaced, so that contact points 12*a*, 13*a* respectively provided on the blade springs 12, 13 contact each other to output a detection signal As a result, the collision of the vehicle is detected.

However, this kind of collision detecting apparatus 20 is usually installed in a front fender disposed on a left or right side of the vehicle. Therefore, the deceleration caused by the collision to be applied to the collision detecting apparatus 20 is liable to have a large magnitude. Upon receiving the deceleration with the high magnitude, the blade spring 13 is liable to vibrate when contacting (receiving) the blade spring 12, resulting in chattering of the detection signal outputted from the collision detecting apparatus. Therefore, it is difficult for the collision detecting apparatus 20 to output a stable detection signal.

If a minimum load (contact load) necessary for holding an ON-state (contacting state) of the contact points 12*a*, 13*a* is increased, the chattering of the detection signal can be mitigated. To increase the contact load, it is effective to thicken the blade spring 12 and to increase an initial deflection amount of the blade spring 12. However, as the blade spring 12 is thickened, it becomes difficult for the blade spring 12 to be elastically deflected, resulting in decrease in the initial deflection amount of the blade spring. Therefore, this method cannot sufficiently prevent the chattering of the detection signal.

SUMMARY OF THE INVENTION

The present invention has been made in view of the above-mentioned problem and an object of the present invention is to provide an anti-chattering contact structure capable of outputting a stable detection signal. Another object of the present invention is to provide a collision detecting apparatus including an anti-chattering structure capable of outputting a stable detection signal.

According to the present invention, a contact structure includes first and second blade spring members respectively having first and second contacts points defining a gap therebetween. The contact structure further includes a driving member biased by the first blade spring member with a bias force in a first direction, i.e., in an opposite direction of the second blade spring member, on an opposite side of the second blade spring member. The driving member is displaced against the bias force in a second direction opposite to the first direction in response to a change of state such as deceleration, so that the first contact point is displaced in the second direction to contact the second contact point. The second blade spring member is composed of several blade springs slidably overlapped with each other in the second direction. As a result, a contact load of the second blade spring member is increased, so that an electrical signal outputted from the contact structure when the first and second contact points contact each other is stable without having chattering thereon.

Preferably, the several blade springs are overlapped with each other to define a specific interval therebetween on an end thereof and to slidably contact each other on the other end thereof. Accordingly, the contact load of the second blade spring member is effectively increased without being dispersed.

Preferably, the several blade springs have lengths different from each other to have different natural frequencies each other. More preferably, one of the several blade springs, which is disposed the most adjacently to the first blade spring member, is the longest. Accordingly, the longest blade spring can be biased by another one of the blade springs at a front end portion thereof, and the gap between the first and second contact points can be easily set.

The contact structure can include a support member biased by the second blade spring member in the first direction on the same side as the first blade spring member with respect to the second blade spring member. Accordingly, the second blade spring member is prevented from being displaced by vibrations and the like, so that the gap between the first and second contact points is adequately maintained. The above-mentioned contact structure can be applied to a collision detecting apparatus. In this case, the driving member is displaced by deceleration caused by a collision.

BRIEF DESCRIPTION OF THE DRAWINGS

These and other objects and features of the present invention will become more readily apparent from a better understanding of preferred embodiments described below with reference to the following drawings.

Figure 1:
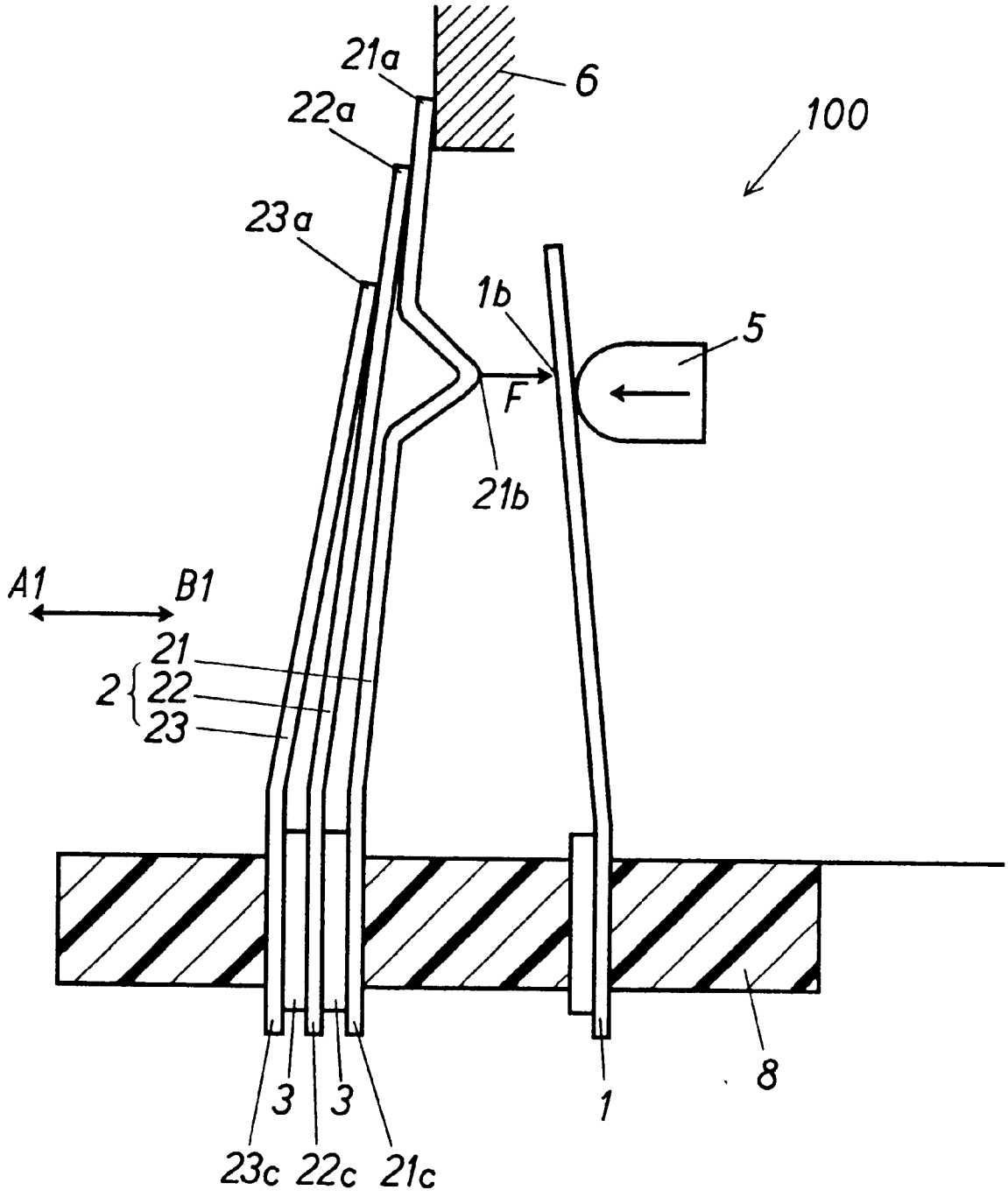
FIG. 1 is a schematic view showing a collision detecting apparatus in a first preferred embodiment of the present invention.

DETAILED DESCRIPTION OF THE PREFERRED EMBODIMENTS (First Embodiment)

In a collision detecting apparatus 100 according to a first preferred embodiment, a pushing side blade spring member (first blade spring member) 1 and a receiving side blade spring member (second blade spring member) 2 are fixed to a resinous base 8 with a specific gap to protrude from the base 8. The receiving side blade spring member 2 is composed of three blade springs 21, 22, 23, each thickness of which is approximately equal to each other. The blade springs 21, 22, 23 are fixed to the base 8 at base portions 21*c*, 22*c*, 23*c* thereof with spacers 3 made of resin or metal disposed between respective two adjacent base portions 21*c*, 22*c*, 23*c* to keep specific gaps therebetween. The blade springs 21, 22, 23 and the spacers 3 are unified in the following manner. First, the spacers 3 are disposed between the base portions 21*c*, 22*c* of the blade springs 21, 22, and between the base portions 22*c*, 23*c* of the blade springs 22, 23, and are fixed there by caulking the blade springs 21, 22, 23. Then, the spacers 3 and the base portions of the blade springs 21, 22, 23 are embedded in the base 8 by resin insert-molding so that the blade springs 21, 22, 23 approximately perpendicularly protrude from the base 8.

The protruding blade springs 21, 22, 23 has lengths different from each other. Specifically, the blade spring 21 which is disposed the most adjacently to the pushing side blade spring member 1 is the longest, and the blade spring 23 which is disposed the most apart from the pushing side blade spring member 1 is the shortest. A front end portion 23*a* of the blade spring 23 abuts the blade spring 22 to elastically bias it with a bias force in a B1 direction. A front end portion 22*a* of the blade spring 22 abuts the blade spring 21 to elastically bias it with a bias force in the B1 direction as well. The blade spring 21 has a convex contact point 21*b* (described later) The front end portions 22*a*, 23*a* of the blade springs 22, 23 respectively contact the blade springs 21, 22, at portions adjacent to the contact point 21*b*. A front end portion 21*a* of the blade spring 21 abuts a support member 6 to elastically bias it with a bias force in the B1 direction. That is, the support member 6 is elastically biased by the receiving side blade spring member 2 in the B1 direction.

The pushing side blade spring member 1 has a plate like contact point 1*b* facing the convex contact point 21*b* of the blade spring 21. A gap between the contact points 1*b* and 21*b* is kept at a specific length. The pushing side blade spring member 1 abuts a driving member 5 on an opposite side of the receiving side spring plate 2 to elastically bias the driving member 5 with a bias force in the B1 direction. Utilized as the driving member 5 is, for example, an eccentric weight (described later) or a ball-cylinder type driving member using a ball-like mass that is attracted by a magnet to be moved under a collision. The driving member 5 mechanically works.

Because the driving member 5 and the support member 6 are respectively biased by the pushing side blade spring member 1 and the receiving side blade spring member 2 in the B1 direction, provided that the deceleration applied to the spring members 1, 2 due to swinging, vibrations, or a sudden brake of the vehicle has a small magnitude, the pushing side and receiving side blade spring members 1, 2 are prevented from being displaced and being vibrated. The contact points 1*b*, 21*b* do not contact each other due to the above-mentioned small deceleration.

When deceleration having a magnitude larger than a specific level is applied to the collision detecting apparatus 100, the driving member 5 is displaced in an A1 direction against the bias force of the pushing side blade spring member 1. The displaced driving member 5 moves the pushing side blade spring member 1 in the A1 direction so that the contact point 1*b* of the blade spring member 1 contacts the contact point 21*b* of the blade spring 21. When the contact points 1*b* and 21*b* contacts each other, an electrical signal is outputted to inform the collision. The electrical signal is used to start a passenger protective system such as an air bag apparatus.

In the collision detecting apparatus 100, a contact load F of the receiving side blade spring member 2, which is applied to the pushing side blade spring member 1 when the contact point 1*b* contacts the contact point 21*b*, is the sum of contact loads of the respective blade springs 21, 22, 23. That is, the contact load F is three times larger than each contact load of the blade springs 21, 22, 23. That is, in this embodiment, the contact load F of the receiving side spring plate 2 is increased without increasing a thickness of each spring plate of the receiving side spring plate 2, i.e., without narrowing a range (elastic deflection range) in which the each spring plate can be elastically deflected. Therefore, even when the deceleration with a large magnitude caused by the collision is applied to the collision detecting apparatus 100, the chattering of the detection signal does not occur. In addition, the spacers 3 are disposed respectively between the adjacent two base portions 21*c*, 22*c*, 23*c* of the spring plate 21, 22, 23 such that only the front end portions 21*a*, 22*a*, 23*a* contact each other. Therefore, the bias forces of the blade springs 21, 22, 23 are effectively concentrated on the contact point 21*b* without being dispersed to the other parts.

Further, when the driving member 5 further moves in the A1 direction against the bias forces of the receiving side and pushing side blade spring members 1, 2 after the contact point 1*b* contacts the contact point 21*b*, the front end portions 22*a*, 23*a* of the blade spring 22, 23 respectively moves on the blade springs 21, 22 to produce frictional forces. The frictional forces additionally prevent the chattering of the detection signal. That is, because the front end portions 22*a*, 23*a* of the spring plates 22, 23 move on the spring plates 22, 21 at portions adjacent to the contact point 21*b*, the contact load F corresponding to an elastic force on the contact point 21*b* can be effectively increased.

Furthermore, because the blade springs 21, 22, 23 have lengths different from each other, natural frequencies of the blade springs 21, 22, 23 are also different from each other. Therefore, resonance of one of the spring plats 21, 22, 23 is prevented by the other. The receiving side spring plate 2 do not resonate as a whole at every frequency. Consequently, there is no possibility that the resonance of the blade spring 2 causes the chattering.

(Second Embodiment)

Figure 2:
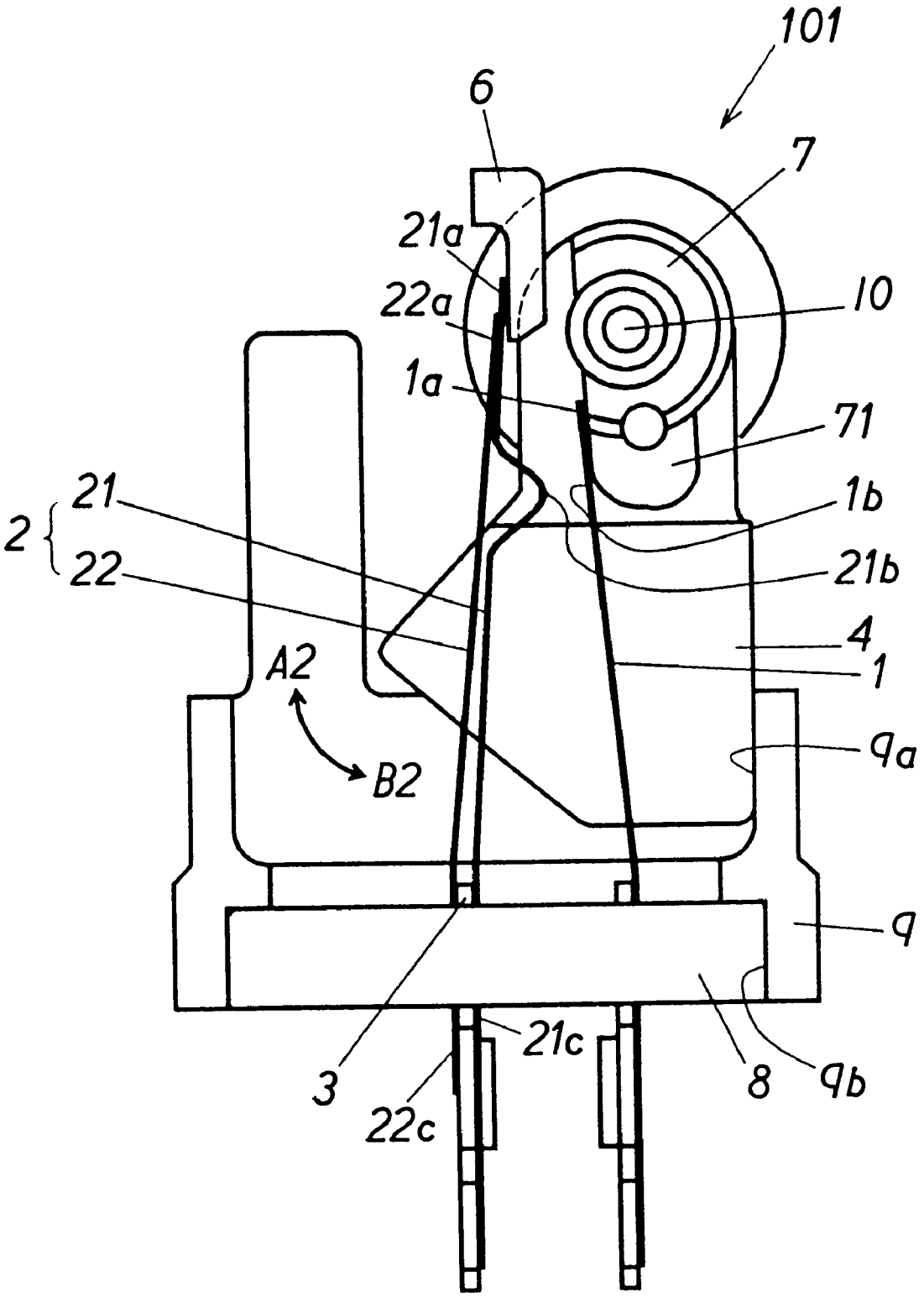
FIG. 2 is a schematic view showing a collision detecting apparatus in a second preferred embodiment of the present invention.

A second preferred embodiment of the present invention will be described with reference to FIG. 2. In the second embodiment, the receiving side blade spring member 2 is composed of two blade springs 21, 22, and a housing and a materialized driving member are employed. The other feature in the second embodiment are substantially the same as those in the first embodiment, and components and parts similar to those in the first embodiment are indicated with the same reference numerals.

A collision detecting apparatus 101 in the second embodiment has a shaft 10, a weight 4 and a rotor 7, which cooperatively serve as the driving member. A resinous housing 9 of the collision detecting apparatus 101 has an inner surface 9*a* for holding the weight 4, a press-fit portion 9*b* into which the base 8 is forced, and a bearing portion for supporting the shaft 10. The shaft 10 made of metal and rotatably supporting the weight 4 and the rotor 7 is fixed to the bearing portion of the housing 9.

The weight 4, which is also made of metal, is eccentrically supported by the shaft 10. When deceleration caused by the collision is applied to the weight 4, a moment is applied to the center of gravity of the weight 4 due to inertia, so that the weight 4 rotates in an A2 direction around the shaft 10.

The rotor 7, which is made of non-metal, is formed with a cam 71. The rotor 7 is fixed to the weight 4 to rotate together with the weight 4 around the shaft 10. The cam 71 is biased by a front end portion 1*a* of the pushing side blade spring member 1 with a bias force in a direction (B2 direction) opposite to the A2 direction, in which the rotor 7 rotates when the collision occurs. The bias force of the pushing side blade spring member 1 against the cam 71 is transmitted to the weight 4 through the rotor 7, so that the weight 4 abuts the inner surface *9*a of the housing 9. Due to the bias force of the pushing side blade spring member 1 against the rotor 7, the weight 4 and the rotor 7 do not rotate when the deceleration applied thereto has a magnitude smaller than a specific level.

In the collision detecting apparatus 101, when the collision occurs to generate deceleration having a magnitude larger than the specific level, the moment is applied to the center of gravity of the weight 4 under the law of inertia, so that the weight 4 rotates in the A2 direction around the shaft 10 against the bias force of the pushing side blade spring member 1. At the same time, the rotor 7 rotates in the A2 direction. By the rotation of the rotor 7, the pushing side blade spring member 1 abutting the cam 71 is displaced toward the receiving side blade spring member 2. When the contact point 1*b* of the pushing side blade spring member 1 contacts the contact point 21*b* of the receiving side blade spring member 2 by the displacement of the pushing side blade spring member 1, an electrical signal is outputted from the collision detecting apparatus 101 to indicate a collision.

As in the first embodiment, the lengths of the spring plates 21, 22 of the receiving side blade spring member 2 are different from each other. Disposed between the spring plates 21 and 22 is a spacer 3 keeping a specific gap therebetween. Therefore, according to this embodiment, substantially the same effects as in the first embodiment can be obtained.

Figure 3A:
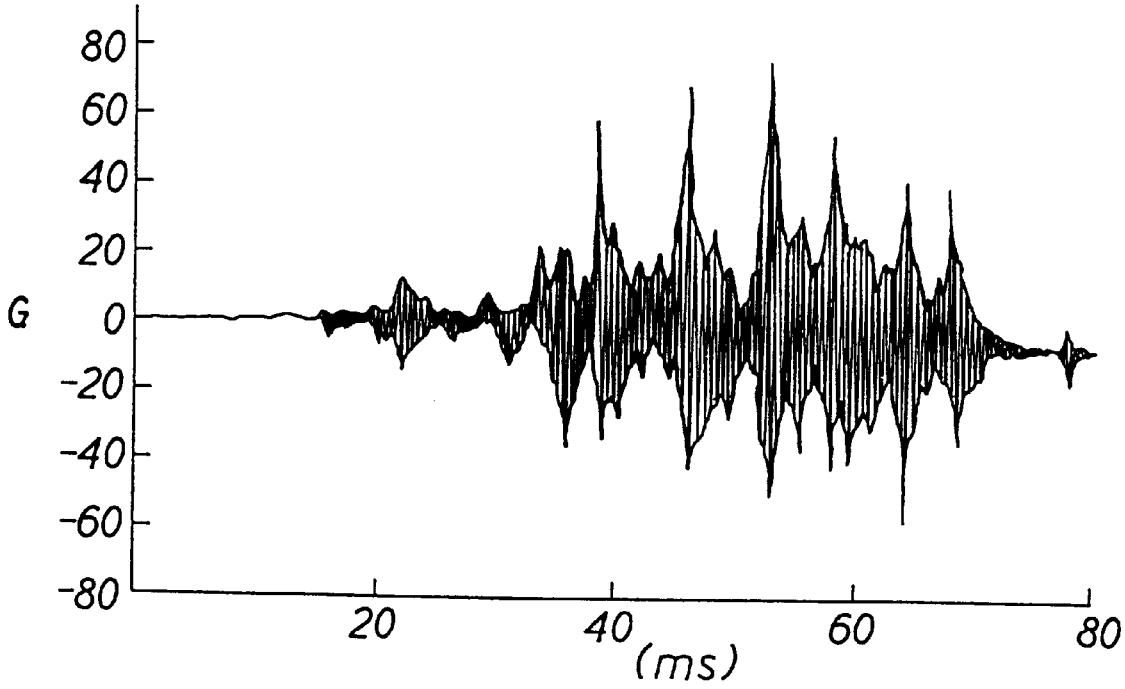
FIG. 3A is a graph showing a waveform of deceleration caused by a collision.
Figure 3B:
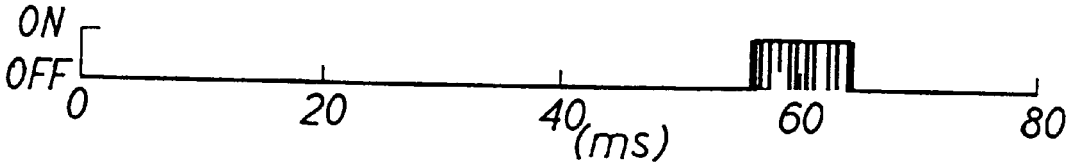
FIG. 3B is a diagram showing a waveform of an output signal corresponding to the deceleration shown in FIG. 3A, outputted from a comparable collision detecting apparatus.
Figure 3C:
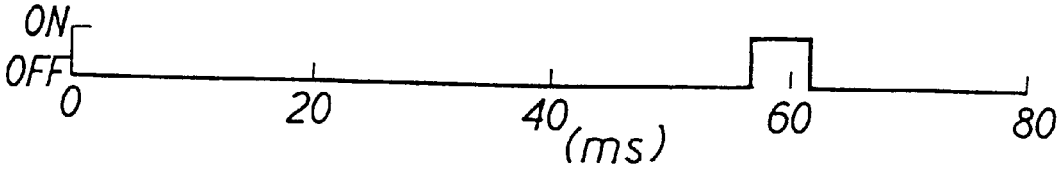
FIG. 3C is a diagram showing a waveform of an output signal corresponding to the deceleration shown in FIG. 3A, outputted from the collision detecting apparatus of the second embodiment.
Figure 4:
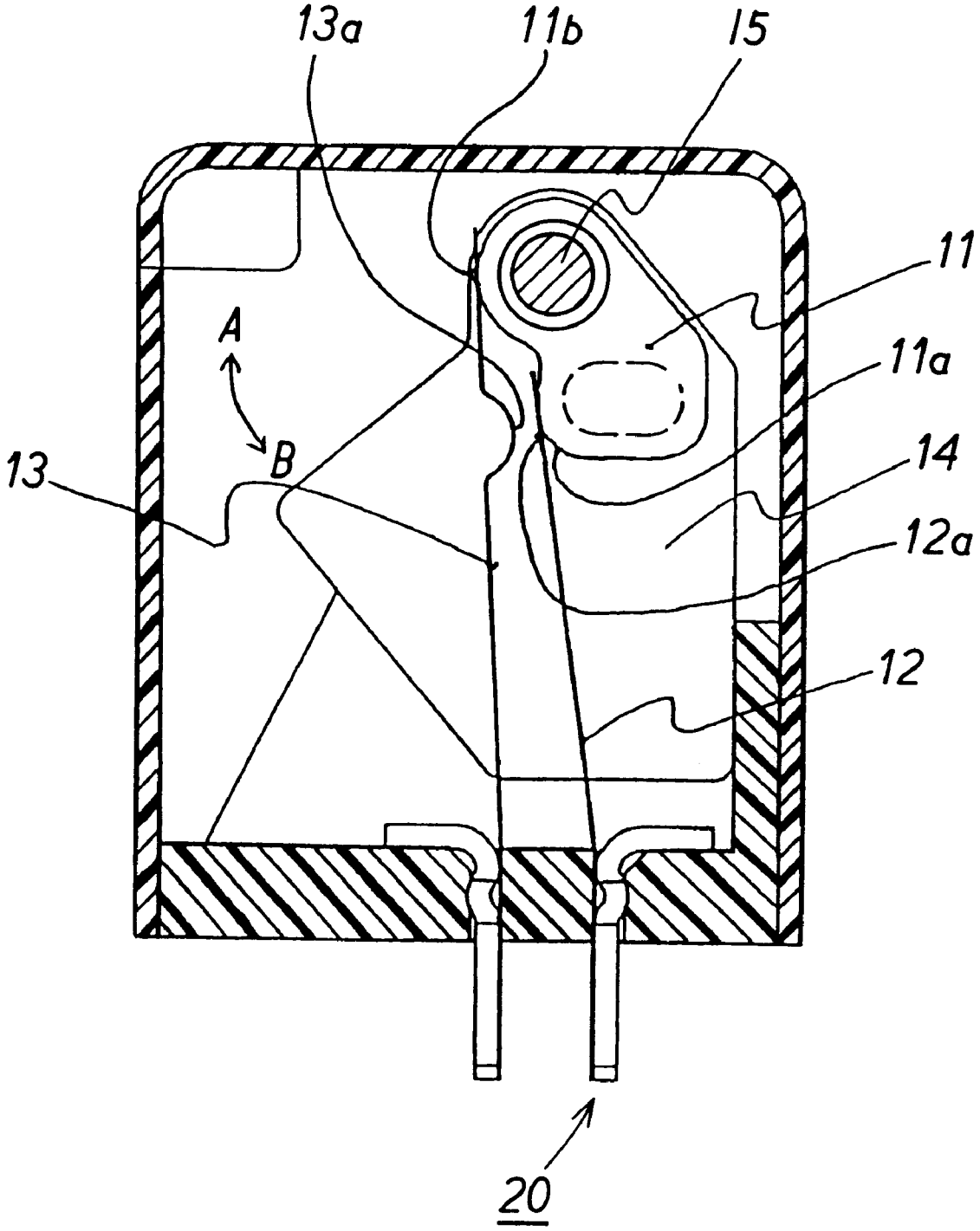
FIG. 4 PRIOR ART
FIG. 4 is a schematic view showing a collision detecting apparatus in a prior art.

FIG. 3A shows a waveform of deceleration caused by the collision. FIG. 3B shows a waveform of an output signal of a comparable collision detecting apparatus, while FIG. 3C is a waveform of an output signal from the collision detecting apparatus 101 in the second embodiment. The comparable collision detecting apparatus has a receiving side blade spring member composed of one blade spring. The output signals shown in FIGS. 3B, 3C are obtained in response to the deceleration shown in FIG. 3A.

When the deceleration is approximately ±80 G in magnitude as shown in FIG. 3A, the output signal of the comparable collision detecting apparatus repeats ON and OFF states with short cycles as shown in FIG. 3B. This is a typical phenomenon of the chattering. As opposed to this, as shown in FIG. 3C, the output signal of the collision detecting apparatus 101 of the second embodiment stably indicates the ON state corresponding to the collision.

In the second embodiment, a cover fitted with the housing 9 may be employed to hermetically hold the collision detecting apparatus 101. The support member 6 can be formed with the cover. The collision detecting apparatus 101 may have a stopper for restricting rotation of the weight 4 to a specific amount. The stopper can have a cover thereof. Although the weight 4 and the rotor 7 are rotatably disposed on the shaft 10, the weight 4 and the rotor 7 may be fixed to the shaft 10. In this case, the shaft 10 is rotatably disposed on the bearing portion of the housing 9.

In the above-mentioned embodiments, the spacers 3 are respectively disposed between the two adjacent blade springs of the receiving side blade spring member 2, however, it is not always necessary to employ the spacers 3, provided that each gap between the two adjacent blade springs of the receiving side blade spring member 2 is kept at a specific distance. For example, the blade springs of the receiving side blade spring member 2 can be inserted into grooves provided on the base 8 with the specific distance in plate of being insert-molded with the base 8.

The contact points 1*b*, 21*b* are constructed to be usually separated from each other and to contact each other when the deceleration more than the specific level is applied to the collision detecting apparatus. Otherwise, the contact points 1*b*, 21*b* may be constructed to usually contact each other and to be separated from each other when the deceleration more than the specific level is applied to the collision detecting apparatus. The number of the blade springs for the receiving side blade spring member 2 is not limited to two or three, and it may be changed if necessary. The detection signal outputted from the collision detecting apparatus can be used to start various passenger protective systems such as an air bag apparatus, a side air bag apparatus and a seat belt take-up apparatus. Further, in the above-mentioned embodiments, although the anti-chattering structure of the present invention is applied to the collision detecting apparatus, it is apparent that the present invention can be applied to the other apparatuses including a contact structure.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A contact structure for outputting an electrical signal in response to a change of state, comprising:

a first blade spring member having a first contact point;

a driving member biased by the first blade spring member with a bias force in a first direction, the driving member displaced against the bias force in response to the change of state to displace the first contact point in a second direction opposite to the first direction; and a second blade spring member disposed on an opposite side of the first blade spring member with respect to the driving member and having a second contact point defining a gap with the first contact point in a non-displaced state and contacting the first contact point displaced by the driving member to output the electrical signal, the second blade spring member composed of several blade springs slidably overlapped with each other in the second direction.

2. The contact structure of claim 1, wherein the several blade springs are overlapped with each other to define a specific interval therebetween on an end thereof and to slidably contact each other on another end thereof.

3. The contact structure of claim 2, wherein the several blade springs contact each other at portions adjacent to the second contact point.

4. The contact structure of claim 1, wherein the several blade springs have lengths different from each other.

5. The contact structure of claim 1, wherein one of the several blade springs, which is disposed most adjacently to the first blade spring member, is longest of all the blade springs.

6. The contact structure of claim 1, further comprising a support member disposed on a same side of the first blade spring member as the second blade spring member and biased by the second blade spring member in the first direction.

7. A collision detecting apparatus for detecting a collision in response to deceleration, comprising:

a first blade spring member having a first contact point;

a driving member biased by the first blade spring member with a bias force in a first direction, the driving member displaced against the bias force in response to the deceleration to displace the first contact point in a second direction opposite to the first direction; and a second blade spring member disposed on an opposite side of the first blade spring member with respect to the driving member and having a second contact point defining a gap with the first contact point in a non-displaced state and contacting the first contact point to output an electrical signal by receiving the first contact point displaced by the driving member, the second blade spring member composed of several blade springs slidably overlapped with each other in the second direction.

8. The collision detecting apparatus of claim 7, wherein the several blade springs are overlapped with each other to define a specific interval therebetween on an end side thereof and to slidably contact each other on another end side thereof.

9. The collision detecting apparatus of claim 8, wherein the several blade springs contact each other at portions adjacent to the second contact point.

10. The collision detecting apparatus of claim 7, wherein the several blade springs have lengths different from each other.

11. The collision detecting apparatus of claim 7, wherein one of the several blade springs, which is disposed most adjacently to the first blade spring member, is longest of all the blade springs.

12. The collision detecting apparatus of claim 7, wherein the driving member comprises;

a shaft;

a weight rotatably and eccentrically supported by the shaft, the weight being for rotating in a direction opposite to the first direction around the shaft by the deceleration; and a rotor fixed to the weight to rotate together with the weight around the shaft and having a cam portion biased by the first blade spring member in the first direction.

13. The collision detecting apparatus of claim 7, further comprising a support member disposed on a same side of the first blade spring member as the second blade spring member and biased by the second blade spring member in the first direction.

14. A contact structure for detecting a change of state, comprising:

a first blade spring having a first contact point thereon;

a driving member biased by the first blade spring member with a bias force in a first direction and displaced against the bias force in response to the change of state in a second direction opposite to the first direction to displace the first contact point in the second direction;

a second blade spring disposed on an opposite side of the first blade spring with respect to the driving member to define a gap with the first blade spring and having a second contact point for receiving the first contact point displaced by the driving member; and a third blade spring contacting the second blade spring on an opposite side of the second blade spring with respect to the first blade spring, wherein the second blade spring is biased by the third blade spring in the first direction.

15. The contact structure of claim 14 wherein the third blade spring slidably contacts the second blade spring.

16. The contact structure of claim 15, wherein a first end portion of the third blade spring defines a gap with a first end portion of the second blade spring, and a second end portion of the third blade spring slidably contacts a second end portion of the second blade spring.

17. The contact structure of claim 16, further comprising a spacer disposed between the first end portions of the second and third blade springs to define the gap therebetween.

18. The contact structure of claim 14, wherein a natural frequency of the second blade spring is different from that of the third blade spring.

19. The contact structure of claim 18, wherein a length of the second blade spring is longer than that of the third blade spring.

* * * * *